US005373430A

United States Patent [19]

McDermott

[11] Patent Number: 5,373,430

[45] Date of Patent: Dec. 13, 1994

[54] WIDE ANGLE BEAM PATTERN LAMP

[76] Inventor: Kevin McDermott, 196 Phillips Dr., Hampstead, Md. 21074

[21] Appl. No.: 869,786

[22] Filed: Apr. 16, 1992

[51] Int. Cl.[5] ..... F21V 7/00

[52] U.S. Cl. ..... 362/299; 362/297; 362/304; 362/346

[58] Field of Search ..... 362/297, 298, 299, 304, 362/346

[56] References Cited

U.S. PATENT DOCUMENTS 4,351,018 9/1982 Fratty ..... 362/297 X 5,008,781 4/1991 Nino ..... 362/346 X

*Primary Examiner*—Stephen F. Husar

[57] ABSTRACT

A vehicular warning light has multiple segments of concave parabolic reflectors assembled for cooperative spreading of the light emitted from a single electric lamp to form an elongated wide angle beam of light in a horizontal plane for alerting the neighborhood to the presence and movement of the emergency vehicle. The axis of revolution of each parabolic reflector is assembled at a differing azimuth angle within the common horizontal plane and the focal points and focal planes of the respective reflectors are dispersed. The equivalent center point of the single light source is therefore defocused relative to at least some of the reflectors. The axis of the elongated light source is centered on the common horizontal plane and is parallel to the fluted light cover lens which is contoured for efficiency in light transmission from the multiple reflectors and for additional spreading and luminous uniformity.

20 Claims, 10 Drawing Sheets

Fig. 1
(PRIOR ART)
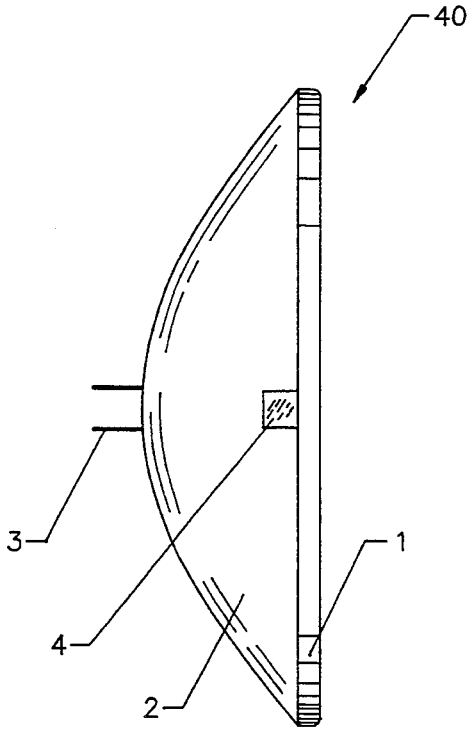
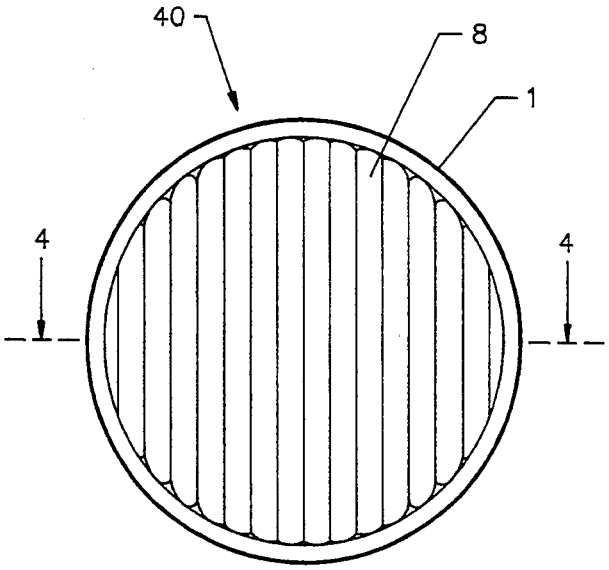
Fig. 2
(PRIOR ART)
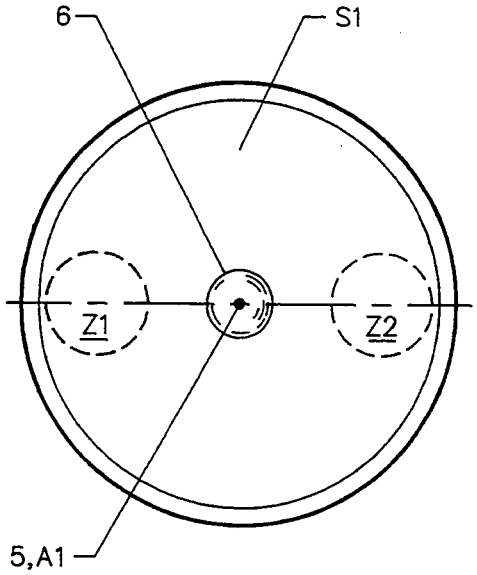
Fig. 3
(PRIOR ART)

Fig. 4
(PRIOR ART)
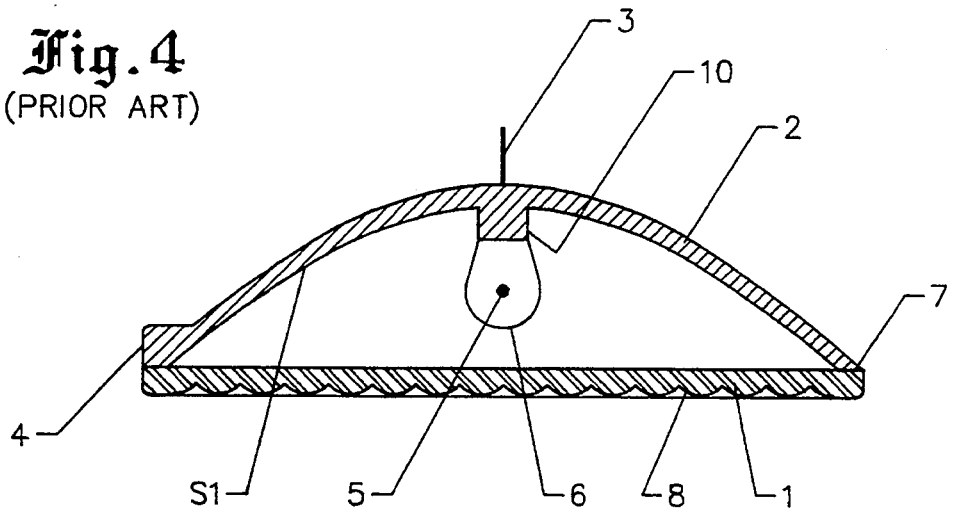
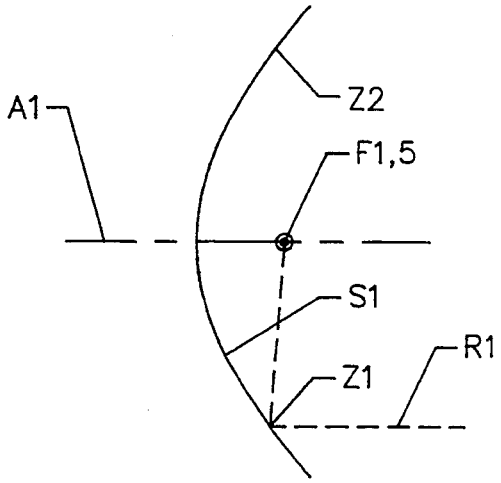
Fig. 5
(PRIOR ART)
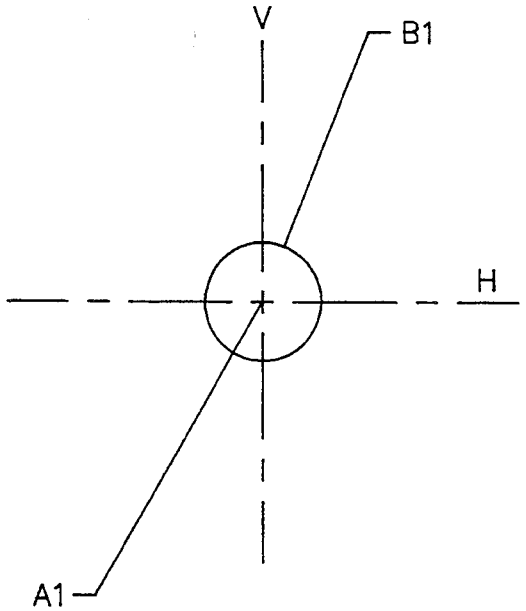
Fig. 6
(PRIOR ART)

Fig. 7
(PRIOR ART)
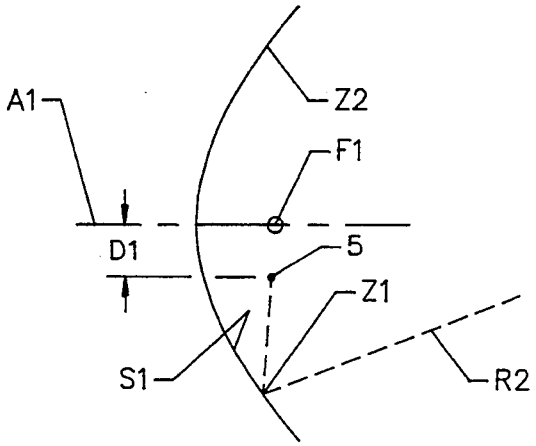
Fig. 8
(PRIOR ART)
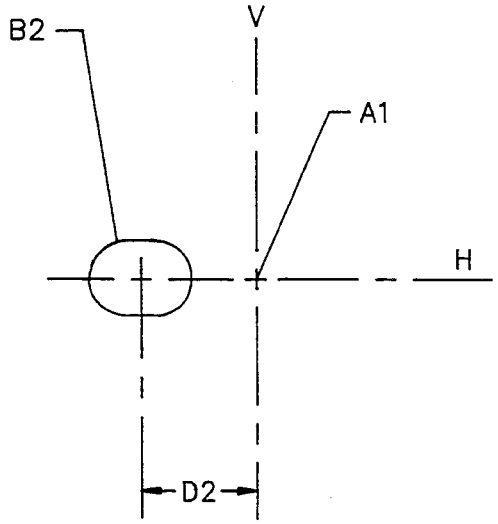
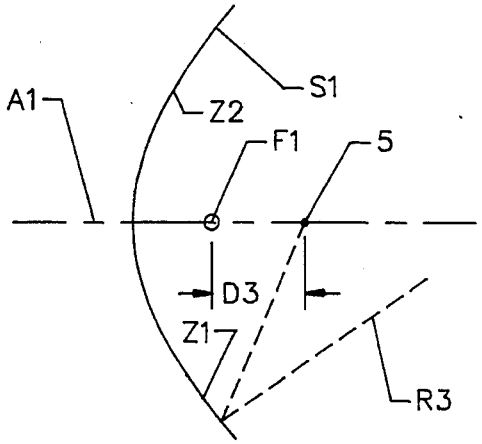
Fig. 9
(PRIOR ART)
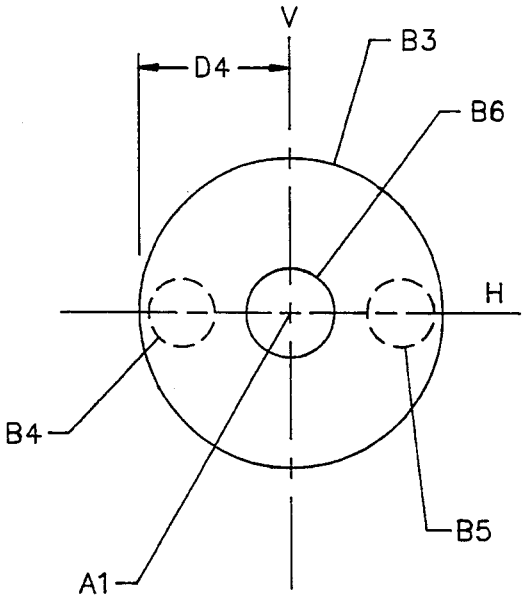
Fig. 10
(PRIOR ART)

Fig. 11
(PRIOR ART)
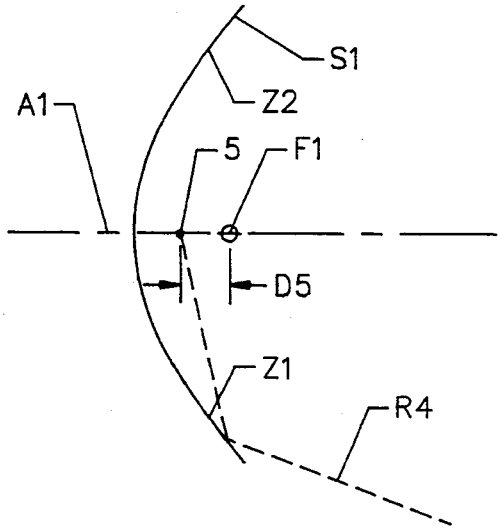
Fig. 12
(PRIOR ART)
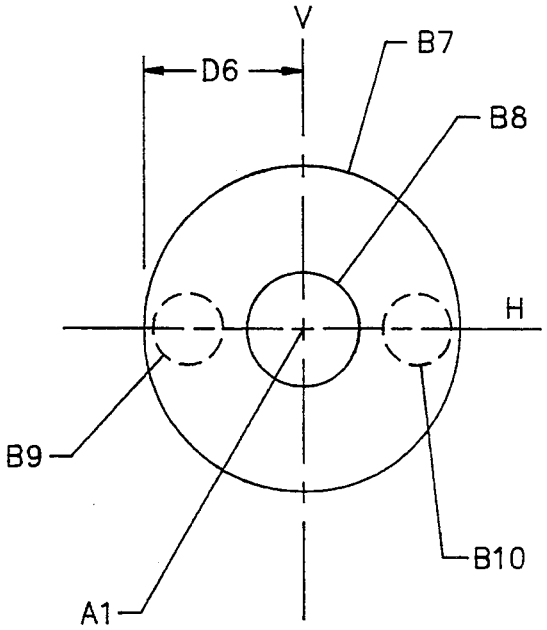
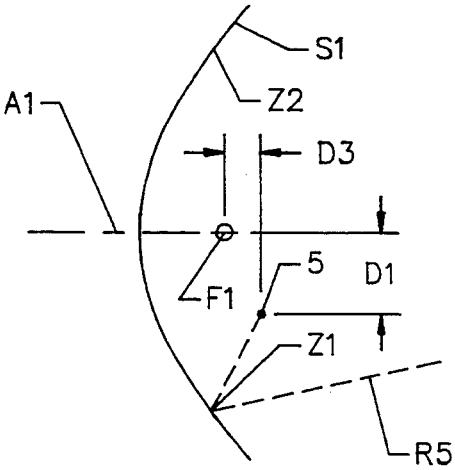
Fig. 13
(PRIOR ART)
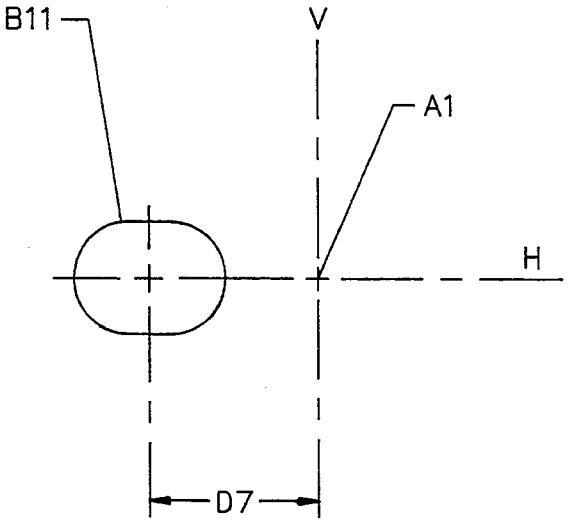
Fig. 14
(PRIOR ART)

Fig. 15
(PRIOR ART)
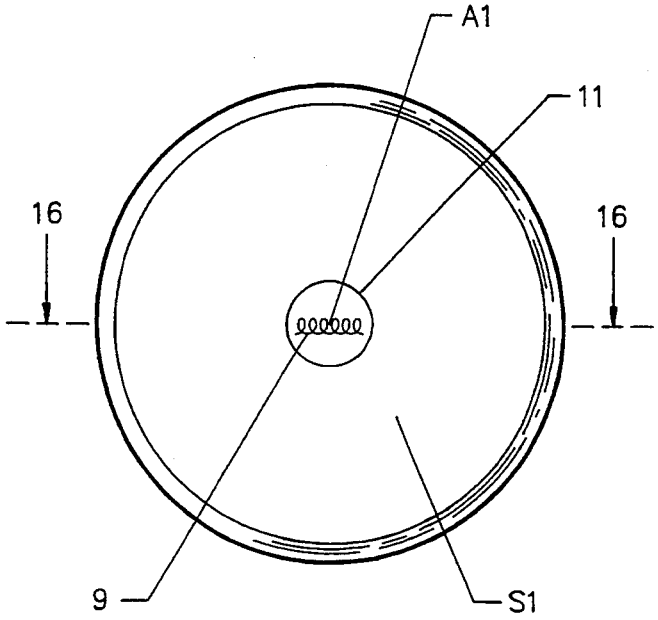
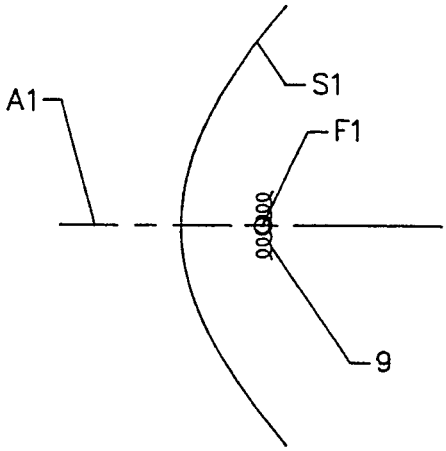
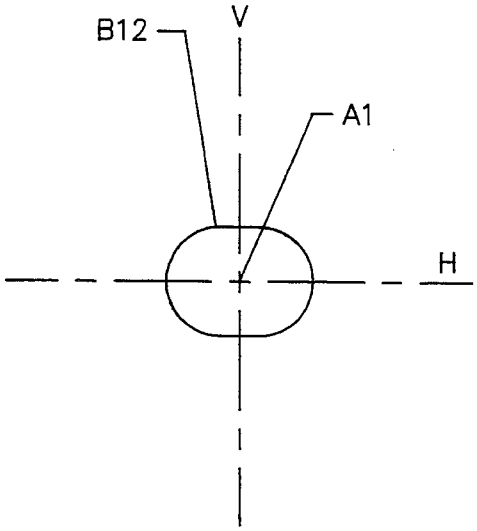
Fig. 16
(PRIOR ART)
Fig. 17
(PRIOR ART)

Fig. 18
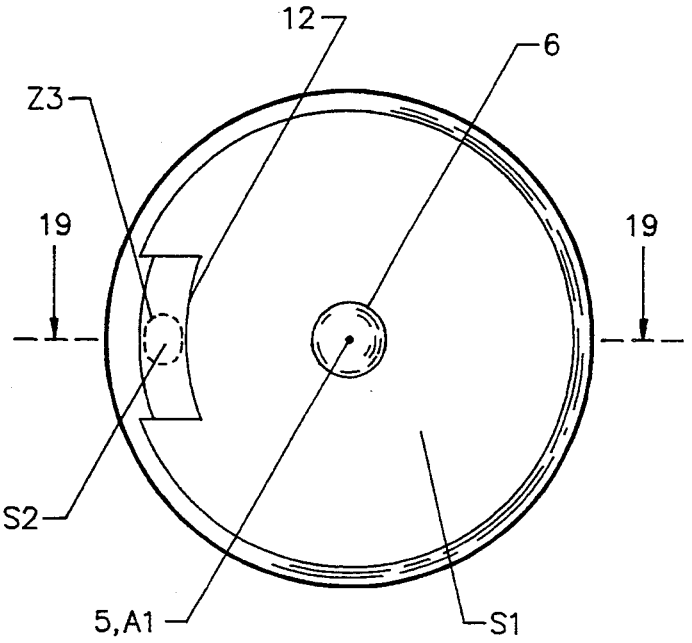
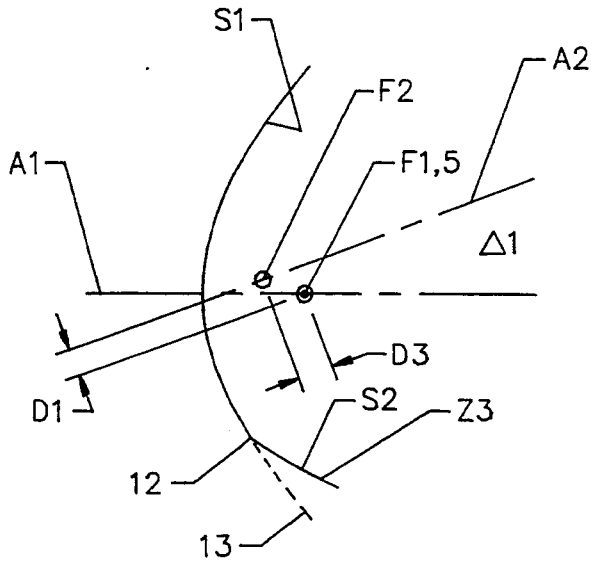
Fig. 19
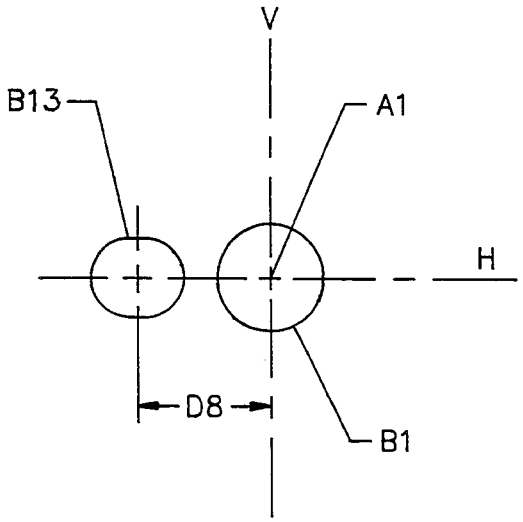
Fig. 20

Fig.21
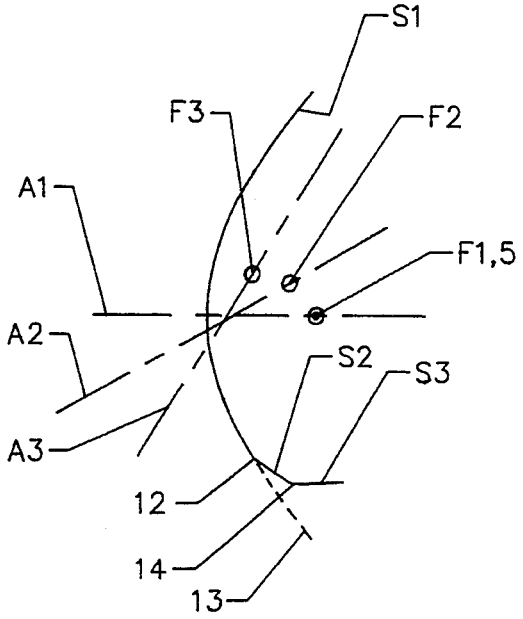
Fig.22
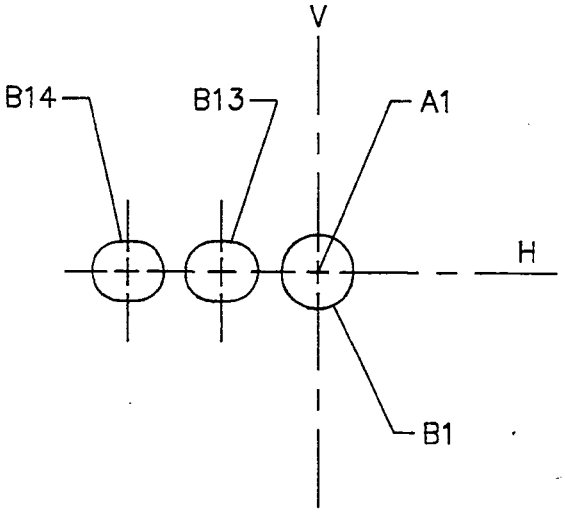
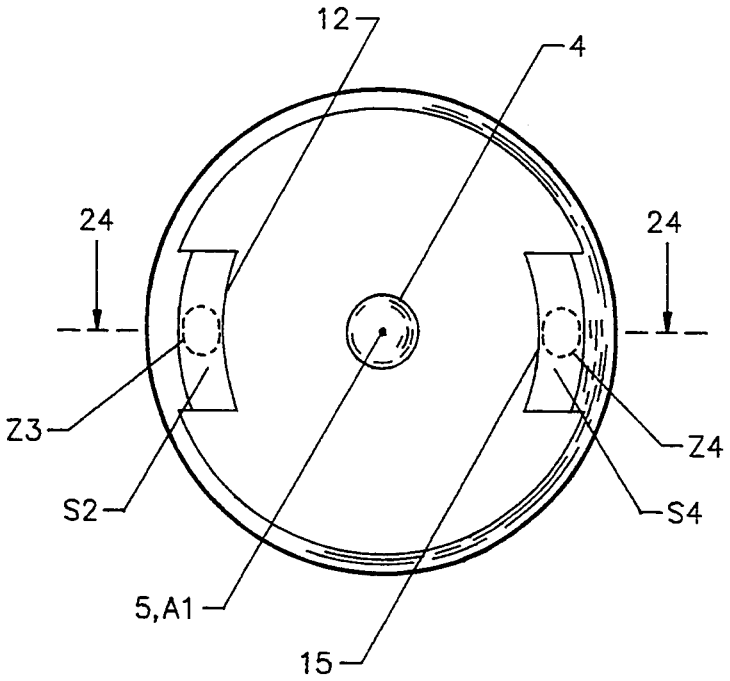
Fig.23

Fig.24
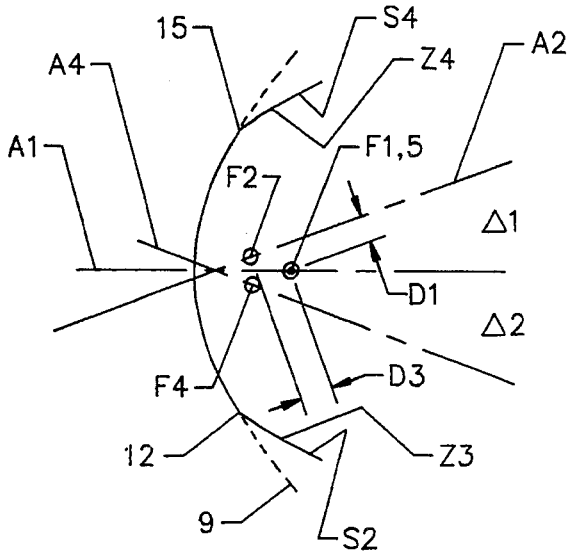
Fig.25
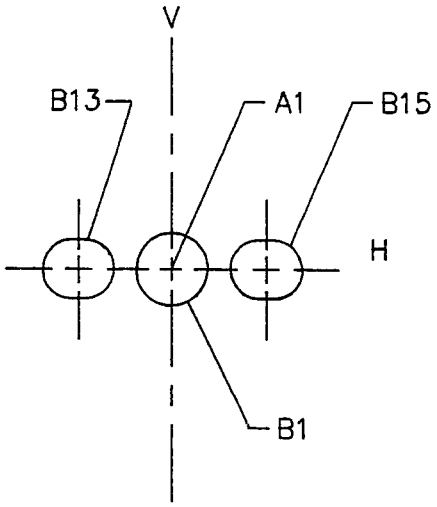
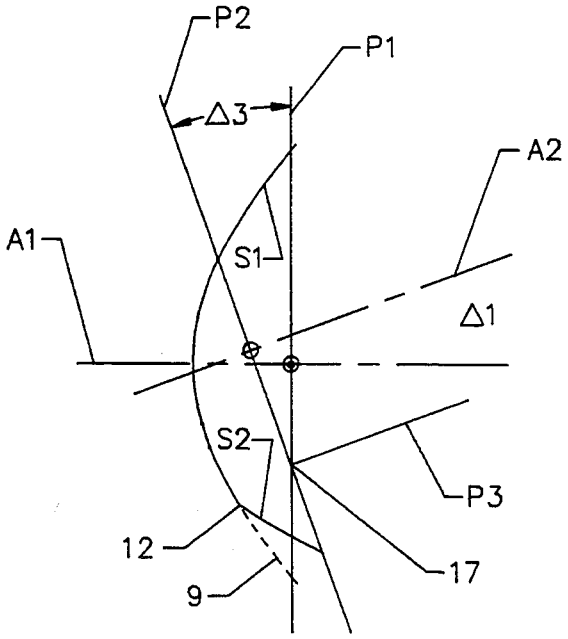
Fig.26

Fig. 27
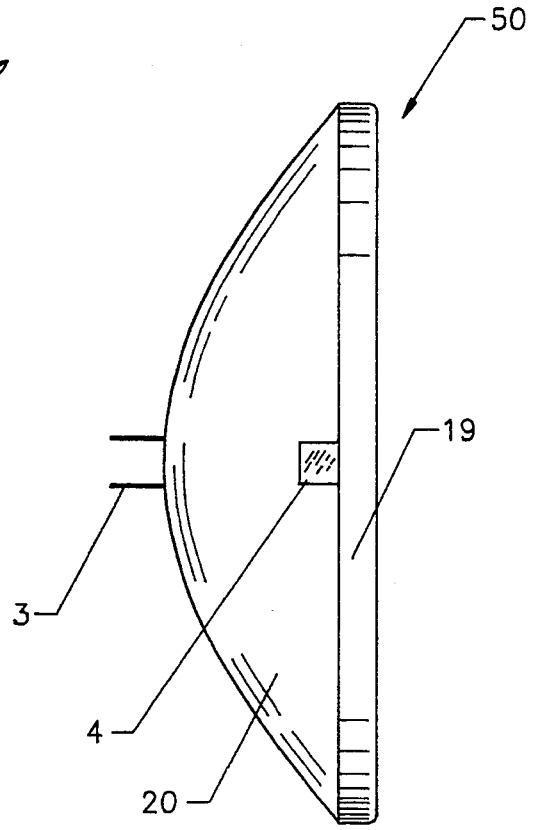
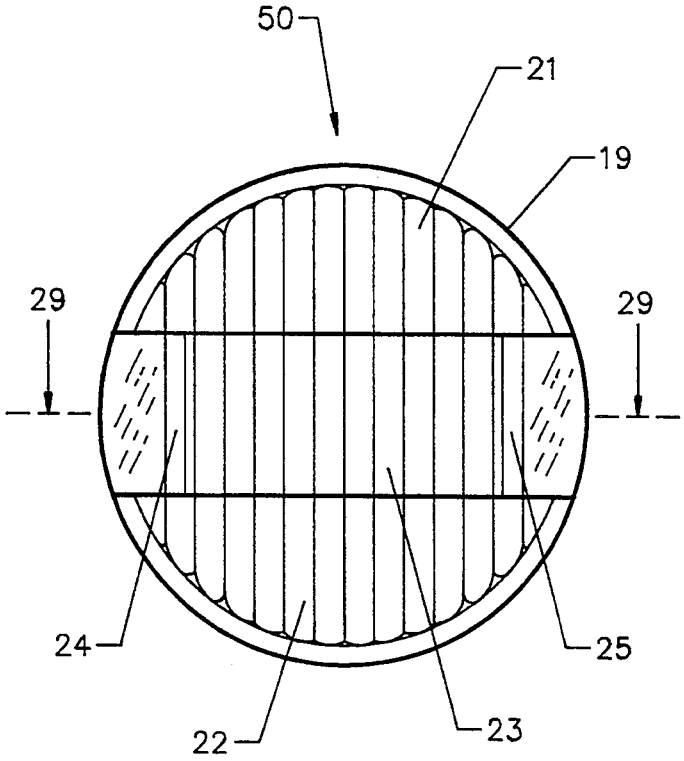
Fig. 28

Fig. 29
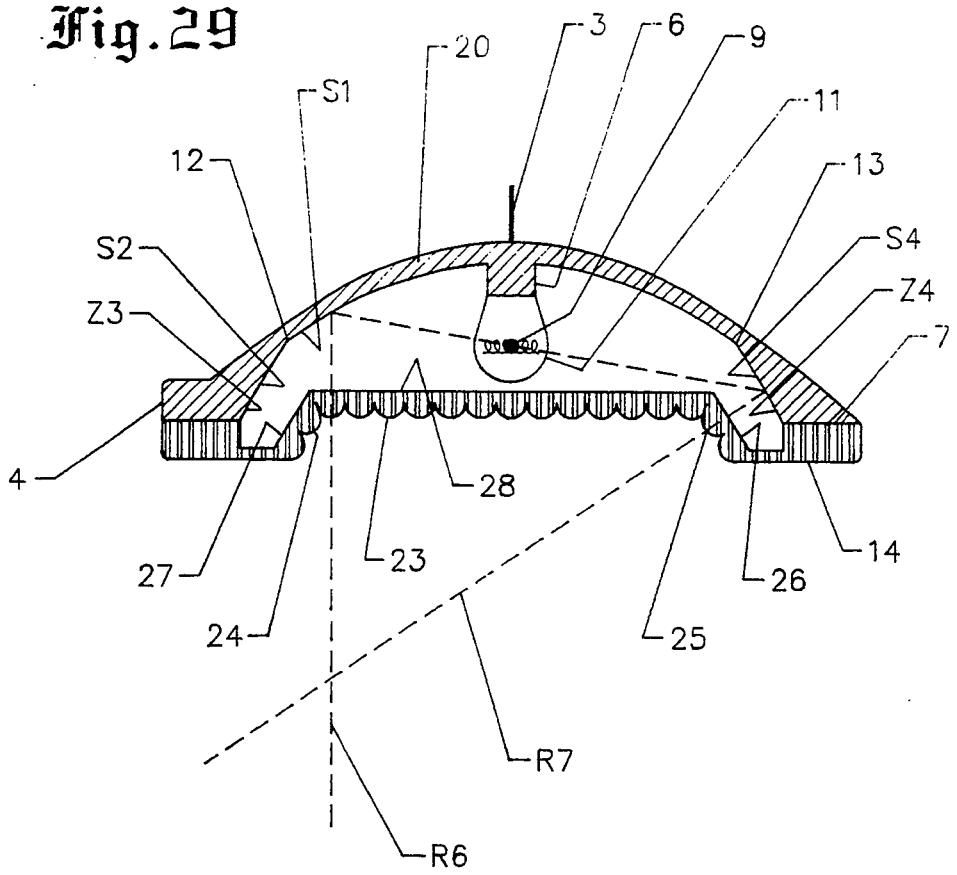
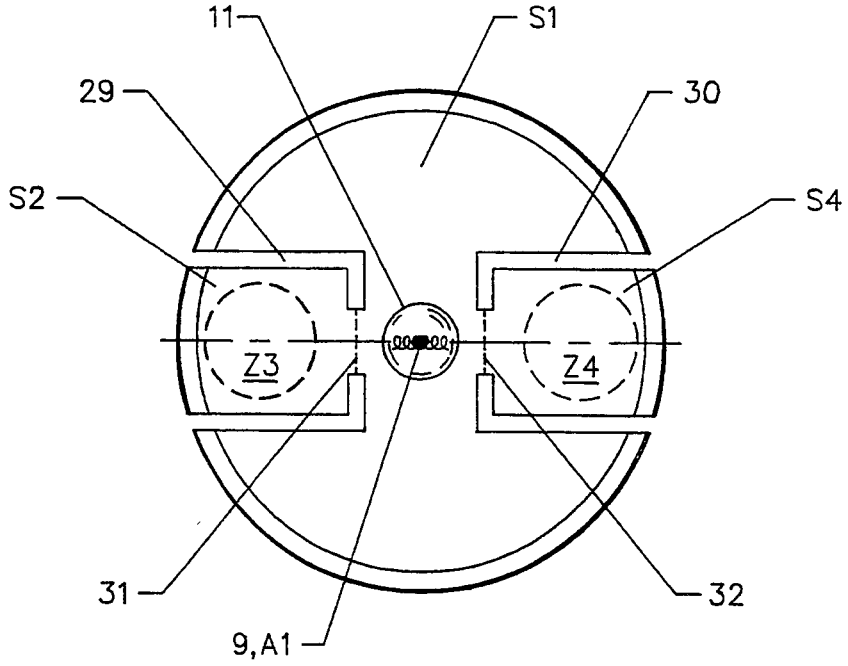
Fig. 30

WIDE ANGLE BEAM PATTERN LAMP

BACKGROUND OF THE INVENTION

1. Field of the Invention

This invention relates to lights, and in particular, to warning lights requiring an elongated wide angle projection pattern for a beam radiating about a single defined spatial plane (hereafter referred to as the horizontal plane).

2. Related Prior Art

Emergency vehicles require their warning lights to have a wide beam pattern in the horizontal plane because it is necessary that approaching cars see the emergency vehicle regardless of their angle of approach. In addition, it is required that the wide angle beam be substantially uniform as bright and dark zones would prevent them from being reliably noticed. Finally, in order to reduce breakage and facilitate mounting, size and configuration restrictions usually apply to the design of these lighting devices. These restrictions create the need to produce a compact light that projects a wide beam.

Prior art has used a ribbed lens in front of the single parabolic reflector to permit the refractive properties of light to spread the beam into a wide beam pattern. Unfortunately, this system did not work efficiently for very wide beam patterns as the lens would require large variations in thickness to drastically bend the light rays. This type of design made the lens both expensive and fragile. In addition, the efficiency of the lens decreased as the required beam spread and corresponding lens thickness increased.

In U.S. Pat. No. 4,954,938 Lyons describes a wide angle lighting device consisting of a lamp, a complex reflector and an optical lens. The reflector consists of sections of three paraboloids of revolution. The central paraboloid with the light source at its focal point projects a central spot beam. The two wing paraboloids of revolution each also with the light source on their focal points project their own spot beams. The axis of revolution of each wing reflector is designed to intersect the axis of the central paraboloid with a given angle. Because the reflected rays are parallel to the axis of each parabola each wing projects its spot beam at that same given angle relative to the central beam. Lyons requires that the focal points of the wings coincide with the focal point of the central paraboloid and light source. This creates a design which prevents maximization of the beam spread for a limited size of the lighting device. A complex ribbed lens is added in a further attempt to spread the beams projected from the three reflectors and to reduce dark areas between the spot zones of the composite beam.

The prior art of Falge et al, relating to a vehicle head lamp, is found in U.S. Pat. No. 1,871,505. The Falge design was not a wide angle lighting device. Furthermore, it was based upon the use of a two filament lamp. It did nevertheless redirect the light beam downward by a second reflective surface.

SUMMARY OF THE INVENTION

My invention provides an elongated wide angle beam pattern by combining sections of two or more concave parabolic reflectors with intersecting focal planes. At least one of the parabolic reflectors has the location of its focal point removed from the central point of the light source. Furthermore, the location of the light source relative to the focal point is chosen to widen the beam spread beyond that which is achieved by prior art designs incorporating angled parabolic reflectors with a common light source and focal point.

The present invention further combines the concepts of two angled parabolic reflectors with the beam altering effects of an off-focus light source placement and elongated filament placement to widen the projected beam. A contoured transparent lens which increases efficiency by permitting the light rays reflected from the wing parabolas to enter the lens at an angle more closely approximating the normal is also provided.

In a preferred embodiment to create a wide angle beam pattern in the horizontal plane a concave central parabolic reflector with two concave cooperating wing parabolic reflectors each angled to the center parabola is provided. All three parabolas have their axis of revolution in the horizontal plane. An elongated light source with its axis in the horizontal plane has its center located at the focal point of the central parabola. The focal points of the wing parabolas are both behind the lamp source with one displaced slightly to the right and the other slightly to the left of the axis of the central paraboloid. The lens or cover includes two sections through which the light reflected from the wing parabolas passes. These sections are contoured so that the angle at which these light rays enter the lens approximates the normal to the interior face of the lens.

One objective of this invention is to create a lighting device which produces a wide angle beam pattern with a minimum of refractive light spreading required by the lens.

Another objective of this invention is to create a lighting device that uses a multiplicity of angled concave parabolic cooperating reflectors to maximize the beam spread.

Another objective of this invention is to create a lighting device that achieves particular beam spread with parabolic surfaces that are easily cleaned because the angle of intersection between the surfaces is minimized for a given beam spread requirement.

Another objective of this invention is to create a lighting device that achieves a required beam spread while it minimizes the angle of intersection between the parabolic reflectors.

Another objective of this invention is to maximize the projected beam spread of the lighting device by combining and correlating the effects of intersecting parabolas and off-focus lamp placement.

Another object of this invention is to provide a lighting device that is less susceptible to overheating.

Another object of this invention is to design a wide angle lighting device that is compact and efficient.

A further objective of this design is to increase the beam spread of a paraboloid of revolution by segmenting and rotating one section of the parabola such that the lamp filament lies on the focus of the original parabola but not on the focus of the rotated segment.

Another object of this invention is to permit a standard parabola reflector to be easily modified so that it projects a wide angle beam pattern from a single light source.

Another objective of this invention is to create a lighting device that requires minimum optical refraction because the parabolas emit an elongated beam pattern which minimizes the dark zones in the beam pattern.

Another object of this invention is to design a lighting device that creates a wide angle beam pattern which requires minimum optical refraction because each of two wing reflectors incorporates at least two parabolic segments with different focal points Further objects and advantages of the present invention will appear hereinbelow.

BRIEF DESCRIPTION OF THE DRAWING

My invention, illustrated most fully in FIGS. 18–30, may be better understood, and its numerous objects and advantages will become apparent to those skilled in the art, by reference to the accompanying drawings wherein like reference numerals refer to like elements in the several FIGs. and in which:

FIG. 1 is a side view of a classical lighting device with a single concave parabolic reflector and a lamp at its focal point. A lens with beam spreading optics provides a cover.

FIG. 2 is a front view of FIG. 1.

FIG. 3 is the same front view as FIG. 2 with the lens removed. Two referenced zones of the reflector are identified.

FIG. 4 is a horizontal sectional view taken along the line 4—4 of FIG. 2.

FIG. 5 is a diagrammatic view of FIG. 4 with the lens and lamp removed. The view has been rotated 90 degrees counter clockwise. The lamp filament is located at the focal point of the parabola.

FIG. 6 is the projected beam pattern from the diagrammatic view of the FIG. 5 lighting device as would be seen by an observer standing behind FIG. 5. It is a spot pattern.

FIG. 7 is a single parabolic reflector and lamp combination as shown in FIG. 5 except the lamp filament is now located to the right of the focal point.

FIG. 8 is the projected beam pattern for the diagrammatic view of the FIG. 7 lighting device as would be seen by an observer standing behind FIG. 7. It is an elongated beam pattern to the left of the vertical on the horizontal axis.

FIG. 9 is a single parabolic reflector and lamp combination as shown in FIG. 5 except the lamp filament is now located on the axis in front of the focal point.

FIG. 10 is the projected beam pattern from the diagrammatic view of the FIG. 9 lighting device as would be seen by an observer standing behind FIG. 9. It is a ring shaped beam pattern with a dark center located at the intersection of the horizontal and vertical axes with a dark center.

FIG. 11 is a single parabolic reflector and lamp combination as shown in FIG. 5 except the lamp filament is now located on the axis between the focal point and parabola.

FIG. 12 is the projected beam pattern from the diagrammatic view of the FIG. 11 lighting device as would be seen by an observer standing behind FIG. 11. It is a ring shaped beam pattern with a dark center located at the intersection of the horizontal and vertical axes.

FIG. 13 is a single parabolic reflector and lamp combination as shown in FIG. 5 except the lamp filament is now located both to the right and to the front of the focal point.

FIG. 14 is the projected beam pattern from a zone of the diagrammatic view of the FIG. 13 lighting device as would be seen by an observer standing behind FIG. 13. It is an elongated spot pattern located on the horizontal plane to the left of the vertical.

FIG. 15 is the same front view as FIG. 3 except the bulb filament is elongated.

FIG. 16 is a diagrammatic view of a horizontal section taken along line 16—16 of FIG. 15 of a single parabolic reflector and lamp combination with the elongated filament located at the focal point.

FIG. 17 is the projected beam pattern for the diagrammatic view of the FIG. 16 lighting device as would be seen by an observer standing behind FIG. 16. It is an elongated spot centered on the horizontal and vertical axes.

FIG. 18 is the front view of the parabola of a lighting device similar to FIG. 3 except that a first wing parabolic reflector has been added.

FIG. 19 is a diagrammatic view of a horizontal section along line 19—19 of FIG. 18 with the lamp filament located at the focal point of the central parabola.

FIG. 20 is the projected beam pattern from the diagrammatic view of the FIG. 18 lighting device as would be seen by an observer standing behind FIG. 19.

FIG. 21 is a diagrammatic view of a lighting device similar to FIG. 19 except the first parabolic wing reflector now consists of two separate parabolic sections. The lamp filament is located at the focus of the central parabola.

FIG. 22 is the projected beam pattern from the diagrammatic view of the FIG. 21 lighting device as would be seen by an observer standing behind FIG. 21.

FIG. 23 is the front view of the parabola of a lighting device which is the subject of the current application similar to FIG. 18 except a second parabolic wing reflector symmetrically located about the vertical has been added.

FIG. 24 is a diagrammatic view of a horizontal section taken along line 24—24 of FIG. 23 with the lamp filament located on the focal point of the center parabola.

FIG. 25 is the projected beam pattern from the diagrammatic view of the FIG. 24 lighting device as would be seen by an observer standing behind FIG. 24.

FIG. 26 is a diagrammatic view of a lighting device similar to FIG. 19. It is used to show reference planes described in this application.

FIG. 27 is the side view of the FIG. 24 lighting device which is the subject of the current application with its lens included.

FIG. 28 is the front view of the FIG. 27 lighting device.

FIG. 29 is a sectional view of FIG. 28 taken along line 29—29.

FIG. 30 is the same front view of the parabola of a lighting device similar to FIG. 3. Saw cuts shown to demonstrate how this single parabolic reflector can be easily modified to form a two wing design as shown in FIG. 23.

DETAILED DESCRIPTION OF THE INVENTION

Referring to the drawings, classical art for the design of vehicular warning lights is illustrated generally by FIGS. 1–17. Typically, FIGS. 1–4, the warning light 40 has an electrical lamp 6 supplied by current through terminals 3 for the emission of light which is reflected from the contours of the inner surface S1. . . , etc., of the body 2 of the housing for transmission as a shaped beam of light through the cover lens 1 which may have integral light spreading parallel ribs or flutes 8. The principal reflecting surface S1 has a concaveous parabolic shape FIG. 5 about the axis of revolution A1. The surface S1 is highly polished and coated with a reflecting metal. In classical prior art the effective point source of the light emitted from the lamp 6 has been located coincident with the focal point F1 of the parabolic reflecting surface S1 for a spot beam B1 of light, FIG. 6.

To achieve my stated objectives for an efficient single lamp elongated beam pattern having a minimum of darkened zones in luminous intensity, in a device of small size and low cost, requires a dispersion among the locations of the focal points of multiple segmented parabolic reflectors and of the center point of the light source within the lamp. The improvements effected in my invention are illustrated in FIG. 18–30. FIG. 18, being a view of the front of the device 50 with lens cover removed, shows lamp 6 with light point center 5 positioned upon the parabolic axis of revolution A1 of the primary surface reflector S1. A secondary reflector S2 has been added in the peripheral skirt of the primary or central reflector S1 with an intersection along line 12. For this discussion the reference zone Z3 of the secondary reflector surface S2 is shown so that optical tracing will reveal spreading of the light beam in wide angles of the horizontal plane H.

A diagrammatic representation of a section of FIG. 18 taken in the direction and along the line 19—19 as indicated is shown in FIG. 19, where S1 is the central or principal reflector, the dotted line 13 is the contour of reflector S1 before the secondary reflector S2 with reference zone Z3 was added. In the diagrammatic geometry of the device 50 the secondary reflector S2 axis of revolution A2 has been rotated through an angle Δ1 relative to the axis A1 of the central reflector S1 and the respective focal points F1 and F2 have been dispersed.

Light source 5 is located at focal point F1. Light source 5 is in front of focal point F2 by a distance D3 and it is to the right of focal point F2 by a distance D1. FIG. 20 shows the projected beam from the FIG. 19 configuration. It consists of a central spot beam pattern B1 created by reflector S1 and an elongated spot beam pattern B13 created by the reference zone Z3 located on S2. Beam pattern B13 is located a distance D8 to the left of the vertical. It should be noted that beam pattern B13 is similar to beam pattern B11 of FIG. 14 which was produced by displacing the lamp point source 5 away from reflector S1 focal point F1 through distances D1 and D3 as shown in FIG. 13. The spreading of the beam shown in FIG. 20 is a result of the fact that light source 5 at focal point F1 is located in front of and to the right of focal point F2 creating a first reflection from beam zone Z3 of surface S2 then intersecting axis A1 and finally diverging in a manner similar to the beam reflected from zone Z1, of surface S1 in FIG. 14. But the distance D8 in FIG. 20 would exceed distance D7 of FIG. 14 because surface S2 and its axis A2 is angled with respect to axis A1.

FIG. 21 is similar to FIG. 19 except reflector S2 is bent about line 14 creating a compound wing reflector S3 with its axis of revolution A3 and focal point F3. The third vertex of the second wing reflector S3 is dispersed from the first and second vertices of the respective S1 and S2 reflectors. Light source 5 is located at focal point F1 but not at the focal points F2 and F3. FIG. 22 shows the projected beam pattern from the FIG. 21 configuration with reflector S1 creating beam pattern B1, reflector S2, creating beam pattern B13, and reflector S3 creating beam pattern B14.

Now having illustrated a concept for the spreading the light from a single lamp source 5 into a wide angle beam a preferred embodiment of my invention is illustrated and described with reference to FIGS. 23–30.

FIG. 23 is similar to FIG. 18 except a second wing reflector S4 has been added. Its location is symmetrically opposite surface S2 and centered about the horizontal so that the projected beam will be widened in the horizontal plane. Line 15 identifies the intersection of surface S1 and S4. FIG. 24 is a diagrammatic view of FIG. 23 showing the light source 5 centered at the focal point F1 of the central reflector S1 creating a central spot beam B1, FIG. 25. Light source 5 is located in front of focal point F2 by a distance D3 and to the right of F2 by a distance D1, FIG. 24. Thus reference zone Z3 on reflector S2 creates an elongated spot crossing over axis A2 projecting beam B13 on the left side of the vertical of FIG. 25.

Similarly light source 5 is in front of and to the left of focal point F4, FIG. 24. Thus reference zone Z4 on S4 creates an elongated spot crossing over axis A4 projecting beam B15 on the right side of the vertical of FIG. 25. It is to be noted that the central parabolic reflector can be deleted for some uses leaving surfaces S2 and S4 to intersect each other. The angle of intersection of S2 and S4 can be adjusted so that their projected beams B13 and B15 overlap at the center providing a more intense central zone.

FIG. 26 shows the geometric relationship between reflectors S1 and S2. Focal plane P1 of surface S1 intersects focal plane P2 of surface S2 along line 17. Plane P3 is drawn perpendicular to P2 along line 17 and extends outwardly away from surface S1. Plane P1 and P2 intersect with an included acute angle of Δ3.

FIG. 27 shows a side view of a lighting device 50 constructed according to the details of the present invention. It includes power leads 3, body 20 and contoured lens 19.

FIG. 28 is a front view of FIG. 27 showing angled exterior surfaces 24 and 25 cooperating with a central surface 23 and top and bottom surfaces 21 and 22 to form lens 19.

FIG. 29 is a sectional view of FIG. 28 taken along lines 29—29. It shows wing reflector S2 with reference zone Z3 and wing reflector S4 with reference zone Z4. These reflectors are integrally molded into body 20. Lamp 11 with elongated light source 9 is positioned parallel to the horizontal plane and perpendicular to axis A1 of reflector S1. Lens 19 shows exterior flutes which can be deleted or placed on the interior surface of the lens and sized or positioned to achieve a particular projected beam pattern. Lens 19 further includes a central exterior section 23 with interior surface 28. Light ray R6 emitted from the center of elongated light source 9 and reflected from reflector S1 enters interior surface 28 substantially along its normal minimizing losses from internal reflections. Upon exiting lens 19 at surface 23 ray R6 would refract spreading the beam depending upon the size and location of flutes. Ray R6 is shown passing straight through lens 19 because it exits at the crest of a flute.

Light ray R7 emitted from light source 9 is reflected from reflector S4 at reference zone Z4. Because reflectors S1 and S4 have intersecting focal planes and the center of light source 9 is shifted both axially and laterally in relation the focal point F4 of S4 exactly as shown in FIG. 24 the reflected ray R7 intersects the axis A1 of reflector S1 more rapidly than the equivalent ray of the prior art design. It correspondingly diverges more rapidly creating a wider beam pattern. Upon emerging from reflector S4 ray R7 enters lens 19 approximately normal to interior surface 26 minimizing losses from internal reflections. Upon exiting lens 19 at surface 25 ray R7 would refract spreading the beam depending upon the size and location of flutes. Ray 7 is shown passing straight through lens 19 because it exits at the crest of a flute. Lens section 24 or 25 can be contoured such that the nominal thickness decreases as one approaches the outside periphery of the light for a further widening of the beam due to refraction at the lens.

FIG. 30 shows how a single parabolic reflector such as shown in FIG. 3 can be modified to create the current invention. Saw cuts 29 and 30 would be made as shown. The wing parabolas S2 and S4 could then be bent inward with all the bending taking place along lines 31 and 32 without the distortion that would be created by attached sides of the wings. Assured bending along lines 31 and 32 assures that reflective surfaces S2 and S4 remain parabolic. In addition it assures that both focal points F2 and F4 are positioned both axially and laterally in the advantageous locations relative to the light source 9 detailed in FIG. 24. It is noted that these wing parabolas could alternately be bent into positions creating nonintersecting focal planes or common focal point light source designs which are inferior and not the basis of the present invention. Furthermore, bending procedures which do not specifically maintain the contour of the original parabola would create wing reflectors which were not parabolic and without focal points. Lighting devices without parabolic wing reflectors would similarly not be equal to the present invention.

Alternatively a device as illustrated by FIG. 29 may be fabricated by molding and metal depositing processes.

The concepts and operation of my invention may be made further apparent by review of the elementary configurations and concepts illustrated in FIGS. 1–17 where an assembled light 40 in accordance with classical Prior Art is indicated generally in FIG. 1. Light 40 will typically include bulb wires 3, a housing or body 2 with a locating pad 4, and a cover or light spreading lens 1. FIG. 2 shows the front view of lens 1 with typical beam spreading flutes 8, FIG. 3 shows the front view of light 40 with lens 1 removed. Here we can see the lamp 6 and reflective surface S1 usually a highly polished parabolic shape coated with a reflecting metal. The axis of revolution of the reflective parabola S1 is located at A1. The concentrated light source 5 shown herein is an incandescent lamp filament. However, numerous other light sources such as light emitting diodes and gas discharge lamps could serve the purpose as well. Reference zones Z1 and Z2 on the surface of reflector S1 are also identified as these will help describe the function of the device. FIG. 4 is a sectional view of FIG. 2. It shows the lamp mount 10 which positions the lamp at the appropriate mount location. In this configuration body 2 has a parabolic interior contour and its interior surface S1 is reflectorized. The lens 1 is optionally cemented to the body 2 at its periphery along 7. FIG. 5 is a diagrammatic view which shows the focal point F1 and axis A1 of parabolic reflective surface S1. Light source 5 is centrally located at focal point F1 and a light ray R1 will reflect off surface S1 in the direction parallel to axis A1. FIG. 6 is the beam pattern B1 projected on a distant wall from the FIG. 5 configuration, This beam pattern is essentially circular and centered about the axis A1 at the intersection of the horizontal and vertical lines. FIG. 7 is similar to FIG. 5 except the light source 5 is located to the right of the focal point F1 by a distance D1, The light ray R2 reflected off zone Z1 now converges upon axis A1. FIG. 8 shows the projected beam B2 from the FIG. 7 configuration. It is oblong in shape and space a distance D2 to the left of vertical.

FIG. 9 is similar to FIG. 5 except the light source 5 is located on axis A1 in front of focal point F1 by a distance D3. In this case light ray R3 reflected off zone Z1 converges upon axis A1 eventually crossing over axis A1. FIG. 10 shows the projected beam B3 from the FIG. 9 configuration. B3 is ring shaped with a dark center B6. A reference section B4 of beam B3 is illuminated by light rays reflected from reference zone Z1. Correspondingly light rays reflected from reference zone Z2 illuminate reference section B5 of beam B3. FIG. 11 is similar to FIG. 5 except the light source 5 is located on axis A1 between focal point F1 and surface S1. Light ray R4 reflecting from zone Z1 now diverges from axis A1. FIG. 12 shows the projected beam B7 from the FIG. 11 configuration. FIG. 12 looks identical to FIG. 10, however, since ray R4 diverges from axis A1 reference section B10 of beam B7 is illuminated by light reflecting from zone Z1 and reference section B9 of B7 is illuminated by light reflecting from zone Z2.

FIG. 13 is similar to FIG. 5 except the light source is placed to the right of focus F1 by a distance D1 and axially in front of focus F1 by a distance D3. Light ray R5 is shown reflecting from reference zone Z1. FIG. 14 shows the projected beam B11 created solely from illumination reflected from reference zone Z1. It is oblong in shape and spaced to the left of the vertical direction a distance D7.

FIG. 15 is a first view of a classical lighting device similar to FIG. 3 with a lamp 11 including an elongated light source 9.

FIG. 16 shows the diagrammatic view of FIG. 16 taken along line 16—16 of FIG. 15 with the light source 9 centered at the focal point F1, perpendicular to axis A1 and parallel to the horizontal axis.

FIG. 17 shows projected beam pattern B12 from the FIG. 16 configuration created by the entire surface S1. It is elongated and located at the intersection of the horizontal and vertical lines centered about axis A1.

Thus for a single parabolic reflector with a light source positioned at a point other than the focal point, the projected beam has a location and shape which is a function of the directional relationship between the light source and focal point. This relationship when used in correct correlation with the appropriate sections of two angled parabolic reflectors projects a beam which is superior to all prior art in its objective of creating a wide angle or diverging beam pattern. For example, if the focal planes of the two parabolic reflectors are angled such that the respective reflected light rays intersect directly in front of the parabolas, they diverge after the initial intersection projecting a wide beam pattern. However, if the light source is in front of the focal point of the appropriate reflector or reflectors, the light rays diverge more quickly projecting an even wider beam pattern. A similar increase of the divergence is achieved if the light source is laterally positioned on the focal plane between the focal point and the surface of the appropriate reflector. If the light source is shifted both laterally and axially with respect to the focal point of the appropriate reflector the projected beam becomes substantially more divergent than all prior art producing a compact lighting device projecting a very wide beam pattern.

Further improvements can be achieved by the use of an elongated light source in combination with angled parabolas and coordinated shifting of the light source center relative to the focus of the appropriate parabola.

The prior art of U.S. Pat. No. 4,954,938 teaches the relationship between parabolic reflectors using the angle of intersection of the axes of revolution. In my invention, I used the angle of intersection of the focal planes. For some uses the angle of intersection of the axes is equal to the angle of intersection of the focal planes. However, there are acceptable configurations of the present invention wherein the axes do not intersect. Therefore, for the present invention the use of intersecting focal planes is more appropriate as it permits the inclusion of highly efficient designs not described in prior art.

My invention yields improvements in wide angle lighting devices because even when a 90 degree beam separation is desired, the required angle of intersection of the two focal planes can exceed 90 degrees. For example a focal plane intersection of one hundred twenty degrees may only be required when a light source is located both axially and laterally off focus to increase the divergence of the emitted beam.

There are several major advantages realized by increasing the angle of intersection of the focal planes. An increased angle of intersection means less bending of the reflectors. The reflective surfaces are more accessible for cleaning and there is more room for lamp replacement. Furthermore the additional spacing between the reflectors increases the efficiency and improves the design parameters because light rays reflected from one reflector are not as readily intercepted and misdirected by the opposite reflector before they exit the housing.

The potential for damage through overheating is also reduced in a design with more space between the reflectors. Increasing the angle of intersection of the focal planes has specific advantages when the designer is using an elongated light source to further widen the beam. The larger the angle of intersection the more possible it becomes to achieve the design objective of simultaneously placing the longitudinal axis of the light source perpendicular to each of the reflectors' axes. Thus for the 90 degree beam if an elongated light source were used in the present invention its longitudinal axis could be positioned within an angle of 30 degrees of its desired angular orientation relative to each reflector's axis rather than the 45 degrees of prior art making the inclusion of an elongated light source more advantageous.

While a preferred embodiment of my invention has been set forth for purposes of illustration, the foregoing description should not be deemed a limitation of the invention herein. Various modifications, adaptations and alternatives may occur to one skilled in the art without departing from the spirit and scope of my invention.

I claim:

1. A lighting device for the projection of an elongated wide angle beam of light in a defined spatial plane wherein the improvement comprises:

a) a light source for the emission of light rays, b) a first reflector for reflecting light rays emitted by said light source to form a first light beam said first reflector comprising:

a portion of a first concave surface of revolution developed about a first axis of revolution, said first surface of revolution having;

a first focal point;

a first vertex;

a first focal length and;

a first focal plane perpendicular to said first axis of revolution intercepting said first focal point;

c) a second reflector for reflecting light rays emitted by said light source to form a second light beam said second reflector comprising:

a portion of a second concave surface of revolution developed about a second axis of revolution, said second surface of revolution having:

a second focal point;

a second vertex;

a second focal length; and a second focal plane perpendicular to said second axis of revolution intercepting said second focal point;

d) means for attachment of said second reflector at an angle with respect to said first reflector such that said second focal plane intersects said first focal plane at a first acute angle of intersection;

e) means for locating said light source relative to said first and said second focal points so that said first and said second reflected light beams first converge, then finally diverge at a first angle of divergence in said defined spatial plane which exceeds said first acute angle of intersection;

f) a third reflector for reflecting light rays emitted by said light source to form a third light beam. Said third reflector comprising:

a portion of a third concave surface of revolution developed about a third axis of revolution, said third surface of revolution having;

a third focal point;

a third vertex;

a third focal length; and a third focal plane perpendicular to said third axis of revolution intercepting said third focal point;

g) means for attachment of said third reflector at an angle with respect to said first reflector such that said third focal plane intersects said first focal plane at a second acute angle of intersection.

2. A lighting device, as per claim 1, wherein the improvement further comprises:

a) a molded body for a composite reflector of said light comprising:

a central concaveous reflecting surface, comprising said first reflector about said first axis of revolution which passes through the center of said light source, said first reflector having said first focal point coincident with said center of said light source;

a portion of a first concaveous wing reflecting surface of revolution comprising said second reflector about a second axis of revolution angled relative to said first axis, said first wing surface located in a peripheral area of said molded body; and a portion of a second concaveous wing reflecting surface of revolution comprising said third reflector about said third axis of revolution angled relative to said first axis, said second wing surface located in the diametrically opposing peripheral area of said molded body; and b) a lens for attachment to said molded body for the transmission of said beam of light, said lens comprising:
a central lens section for transmission of light rays reflected from said first reflector along paths substantially normal to the interior surface of said central lens section;
a first wing lens section integrally contoured and angled in the peripheral area of said central lens section for the transmission of received light rays reflected from said second reflector along paths substantially normal to the interior surface of said first wing lens section;
a second wing lens diametrically located and integrally contoured and angled in the opposing peripheral area of said central lens section for the transmission of received light rays reflected from said third reflector along paths substantially normal to the interior surface of said second wing lens section; and
c) means for establishing optical registry between said second and said third reflectors and said first and said second wing lens sections, respectively.

3. A lighting device, as per claim 1, wherein the improvement further comprises:
a) a multiplicity of parallel ridged flutes for said lens for refractive spreading of said wide angle beam of light; and
b) a locating pad for said molded reflector body for establishing and maintaining said defined spatial plane in a specified direction.

4. A lighting device as per claim 1, wherein the improvement further comprises:
a) said first reflector formed of a bendable material;
b) said second reflector comprising a first wing reflecting sector formed by multiple lateral inward cuts from the periphery of said first reflector and by bending said first wing reflecting sector inward toward said first axis of revolution, and;
c) said third reflector comprising a second wing reflecting sector formed by multiple inward cuts from the diametrically opposing periphery of said first reflector and by bending said second wing reflecting sector inward toward said first axis of revolution.

5. A lighting device for the projection of an elongated wide angle beam of light in a defined spatial plane wherein the improvement comprises:
a) a light source for the emission of light rays,
b) a first reflector for reflecting light rays emitted by said light source to form a first light beam said first reflector comprising:
a portion of a first concave surface of revolution developed about a first axis of revolution, said first surface of revolution having:
a first focal point;
a first vertex;
a first focal length and;
a first focal plane perpendicular to said first axis of revolution intercepting said first focal point;
c) a second reflector for reflecting light rays emitted by said light source to form a second light beam said second reflector comprising:
a portion of a second concave surface of revolution developed about a second axis of revolution, said second surface of revolution having:
a second focal point;
a second vertex;
a second focal length; and
a second focal plane perpendicular to said second axis of revolution intercepting said second focal point;
d) means for attachment of said second reflector at an angle with respect to said first reflector such that said second focal plane intersects said first focal plane at a first acute angle of intersection;
e) means for locating said light source relative to said first and said second focal points so that said first and said second reflected light beams initially converge, then finally diverge at a first angle of divergence in said defined spatial plane which exceeds said first angle of intersection;
f) means for assembly of said light source and said first reflector wherein said first light beam initially converges upon said first axis of revolution then diverges from said first axis of revolution for increased final divergent spreading of said first and said second light beams in said defined spatial plane, said means including:
i) locating said first reflector on the side of said first focal plane facing said first vertex; and
ii) locating said light source between said first reflector and a plane that is perpendicular to said defined spatial plane and coincident with said first axis of revolution,
g) a third reflector of light for reflecting light rays emitted by said light source to form a third light beam said third reflector comprising:
a portion of a third concave surface of revolution developed about a third axis of revolution, said third surface of revolution having;
a third focal point;
a third vertex;
a third focal length; and
a third focal plane perpendicular to said third axis of revolution intercepting said third focal point;
h) means for attachment of said third reflector at an angle with respect to said first reflector such that said third focal plane intersects said first focal plane at a second acute angle of intersection.

6. A lighting device as per claim 1 or 5 wherein: said light source is located at said second focal point.

7. A lighting device for the projection of an elongated wide angle beam of light in a defined spatial plane wherein the improvement comprises:
a) a light source for the emission of light rays,
b) a first reflector for reflecting light rays emitted by said light source to form a first light beam said first reflector comprising,
a portion of a first concave surface of revolution developed about a first axis of revolution, said first surface of revolution having:
a first focal point;
a first vertex;
a first focal length and;
a first focal plane perpendicular to said first axis of revolution intercepting said first focal point;
c) a second reflector for reflecting light rays emitted said light source to form a second light beam said second reflector comprising:
a portion of a second concave surface of revolution developed about a second axis of revolution, said second surface of revolution having:
a second focal point;
a second vertex;
a second focal length; and a second focal plane perpendicular to said second axis of revolution intercepting said second focal point;

d) means for attachment of said second reflector at an angle with respect to said first reflector such that said second focal plane intersects said first focal plane at a first acute angle of intersection;

e) means for locating said light source relative to said first and said second focal points so that said first and said second reflected light beams first converge, then finally diverge at a first angle of divergence in said defined spatial plane which exceeds said first acute angle of intersection;

f) means for assembly of said light source and said first reflector wherein said first light beam initially converges upon said first axis of revolution then diverges from said first axis of revolution for increased final divergent spreading of said first and said second light beams in said defined spatial plane, said means including;

i) locating said first reflector on the side of said first focal plane facing said first vertex; and ii) locating said light source between said first reflector and a plane that is perpendicular to said defined spatial plane and coincident with said first axis of revolution, g) means for assembly of said light source and said second reflector wherein said second light beam initially converges upon said second axis of revolution then diverges from said second axis of revolution for increased final divergent spreading of said first and said second light beams in said defined spatial plane, said means including:

i) locating said second reflector on the side of said first focal plane facing said second vertex; and ii) locating said light source between said second reflector and a plane that is perpendicular to said defined spatial plane and coincident with said second axis of revolution, h) a third reflector of light for reflecting light rays emitted by said light source to form a third light beam said third reflector comprising:

a portion of a third concave surface of revolution developed about a third axis of revolution, said third surface of revolution having;

a third focal point;

a third vertex;

a third focal length; and a third focal plane perpendicular to said third axis of revolution intercepting said third focal point;

i) means for attachment of said third reflector at an angle with respect to said first reflector such that said third focal plane intersects said first focal plane at a second acute angle of intersection.

8. A lighting device as per claim 1, 5 or 7 wherein: said light source is located at said third focal point.

9. A lighting device as per claim 1, 5 or 7 which comprises:

means for locating said light source relative to said first and said third focal points so that said first and said third reflected light beams first converge, then finally diverge at a second angle of divergence in said defined spatial plane which exceeds said second acute angle of intersection.

10. A lighting device for the projection of an elongated wide angle beam of light in a defined spatial plane wherein the improvement comprises:

a) a light source for the emission of light rays, b) a first reflector for reflecting light rays emitted by said light source to form a first light beam said first reflector comprising:

a portion of a first concave surface of revolution developed about a first axis of revolution, said first surface of revolution having:

a first focal point;

a first vertex;

a first focal length and;

a first focal plane perpendicular to said first axis of revolution intercepting said first focal point;

c) a second reflector for reflecting light rays emitted by said light source to form a second light beam said second reflector comprising:

a portion of a second concave surface of revolution developed about a second axis of revolution, said second surface of revolution having:

a second focal point;

a second vertex;

a second focal length; and a second focal plane perpendicular to said second axis of revolution intercepting said second focal point;

d) means for attachment of said second reflector at an angle with respect to said first reflector such that said second focal plane intersects said first focal plane at a first acute angle of intersection;

e) means for locating said light source relative to said first and said second focal points so that said first and said second reflected light beams first converge, then finally diverge at a first angle of divergence in said defined spatial plane which exceeds said first acute angle of intersection;

f) means for assembly of said light source and said first reflector wherein said first light beam initially converges upon said first axis of revolution for increased final divergent spreading of said first and said second light beams in said defined plane, said means including:

i) locating said first reflector on the side of said first focal plane facing said first vertex; and ii) locating said light source between said first reflector and a plane that is perpendicular to said defined spatial plane and coincident with said first axis of revolution, g) means for assembly of said light source and said second reflector wherein said second light beam initially converges upon said second axis of revolution then diverges from said second axis of revolution for increased final divergent spreading of said first and said second light beams in said defined spatial plane, said means including:

i) locating said second reflector on the side of said second focal plane facing said second vertex; and ii ) locating said light source between said second reflector and a plane that is perpendicular to said defined spatial plane and coincident with said second axis of revolution, h) a third reflector of light for reflecting light rays emitted by said light source to form a third light beam said third reflector comprising:

a portion of a third concave surface of revolution developed about a third axis of revolution, said third surface of revolution having;

a third focal point;

a third vertex;

a third focal length; and a third focal plane perpendicular to said third axis of revolution intercepting said third focal point;

i) means for attachment of said third reflector at an angle with respect to said first reflector such that said third focal plane intersects said first focal plane at a second acute angle of intersection, j) means for locating said light source relative to said first and said third focal points such that said first and said third reflected light beams first converge, then finally diverge at a second angle of divergence in said defined spatial plane which exceeds said second acute angle of intersection;

k) means for assembly of said light source and said third reflector wherein said third light beam initially converges upon said third axis of revolution then diverges from said third axis of revolution for increased final divergent spreading of said first and said third light beams in said defined plane, said means including:

i) locating said third reflector on the side of said third focal plane facing said third vertex; and ii) locating said light source between said third reflector and a plane that is perpendicular to said defined spatial plane and coincident with said third axis of revolution.

11. A lighting device as per one of claims 1 thru 10 wherein:

said first and said second focal points are at separate locations.

12. A lighting device as per one of claims 1 thru 10 wherein:

said means for locating said light source relative to said first and said second focal points includes:

locating said light source beyond the side of said first focal plane opposite said first vertex.

13. A lighting device as per one of claims 1 thru 10 wherein:

said means for locating said light source relative to said first and said second focal points includes:

locating said light source beyond the side of said first focal plane opposite said first vertex; and locating said light source beyond the side of said second focal plane opposite said second vertex.

14. A lighting device as per one of claims 1 thru 10 wherein:

said first and said second surfaces of revolution are paraboloids.

15. A lighting device as per one of claims 1 thru 10 wherein:

said first and said second reflectors are portions of a single paraboloid.

16. A lighting device, as per one of claims 1 thru 10 wherein: light source comprises:

a) an elongated light source positioned parallel to said defined spatial plane.

17. A lighting device as per one of claims 1 thru 10 wherein:

said first, said second and said third surfaces of revolution are paraboloids.

18. A lighting device as per one of claims 1 thru 10 wherein:

said first, said second and said third reflectors are portions of a single paraboloid.

19. A lighting device as per one of claims 1 thru 10 wherein:

at least two of said first, said second, and said third reflectors are located on opposite side of a geometric plane drawn perpendicular to said defined spatial plane and through the center of said light source for substantially symmetrical spreading of said wide angle beam of light about said geometric plane.

20. A lighting device as per one of claims 1 thru 10 which further includes:

a lens comprising:

a) a first lens section with a first interior surface for transmitting said first beam of light, b) a second lens section with a second interior surface for transmitting said second beam of light, c) a third lens section with a third interior surface for transmitting said third beam of light, d) means to attach said lens to said first, said second and said third reflectors so that said first light beam impinges upon said first lens section along a path substantially normal to aid first interior surface, and;

said second light beam impinges upon said second lens section along a path substantially normal to said second interior surface, and;

said third light beam impinges upon said third lens section along a path substantially normal to said third interior surface.

* * * * *